United States Patent [19]

Stanbery et al.

[11] Patent Number: 4,549,351

[45] Date of Patent: Oct. 29, 1985

[54] COVING CUTTER ASSEMBLY

[76] Inventors: Dan P. Stanbery, 428 Maple Ave.; Juan A. Valero, 365 Bixby Dr., both of Milpitas, Calif. 95035

[21] Appl. No.: 412,256

[22] Filed: Aug. 27, 1982

[51] Int. Cl.[4] ..... B26B 29/00

[52] U.S. Cl. ..... 30/293; 30/294

[58] Field of Search ..... 30/294, 287, 290, 292, 30/293; 33/41 E, 41 F, 41 R, 41 D, 42, 44

[56] References Cited

U.S. PATENT DOCUMENTS 2,305,065 12/1942 Corkish ..... 33/42

3,844,038 10/1974 Kelly et al. ..... 30/293

*Primary Examiner*—Douglas D. Watts

*Attorney, Agent, or Firm*—Paul L. Hickman

[57] ABSTRACT

A hand-operated cutter of flooring material characterized by a substantially rectangular base supported by three cylindrical roller wheels, a pair of guide posts rising from a upper surface of the base, a cutter plate adjustably attached to the guide posts, and a pair of razor blades angularly clamped to opposing ends of the cutter plate. The device also includes cove forming mechanism including a pair of separated, half-spherical wheels adapted to urge the flooring material into the juncture between the floor and wall surfaces. The height of the cutter plate above the base is adjustable to cut the flooring material at a user selectable height above the floor.

4 Claims, 4 Drawing Figures

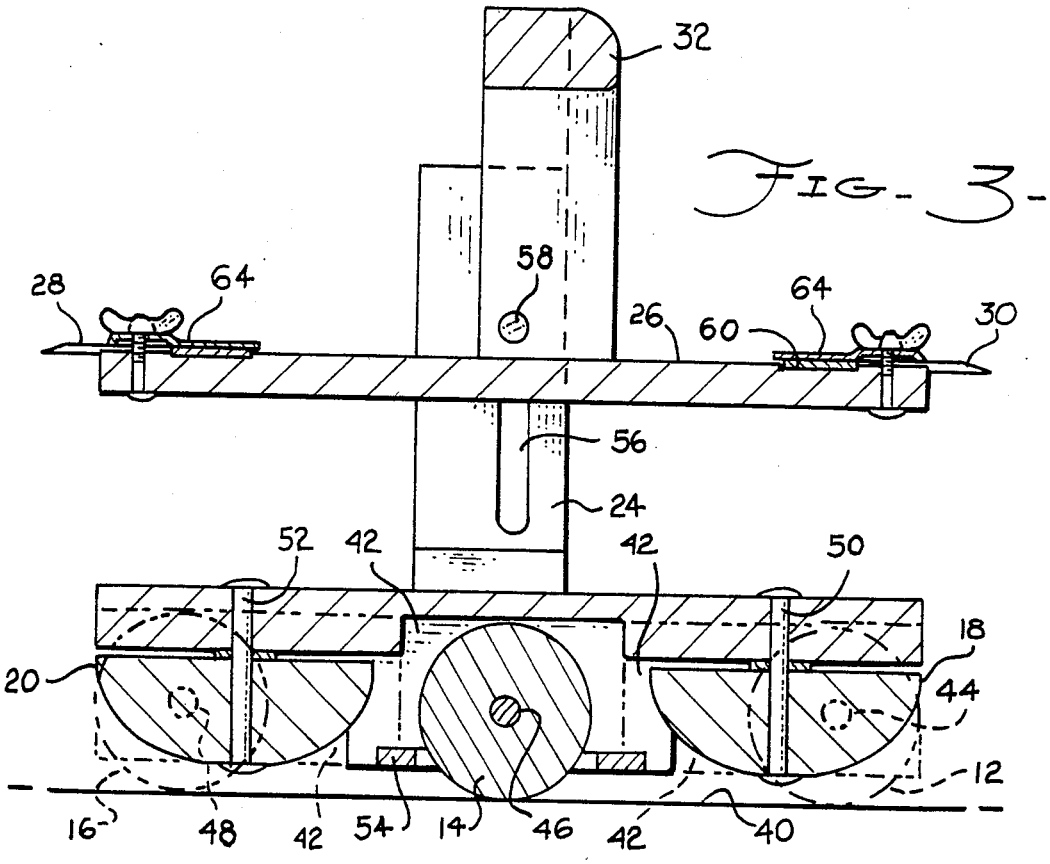
FIG. 3
FIG. 4
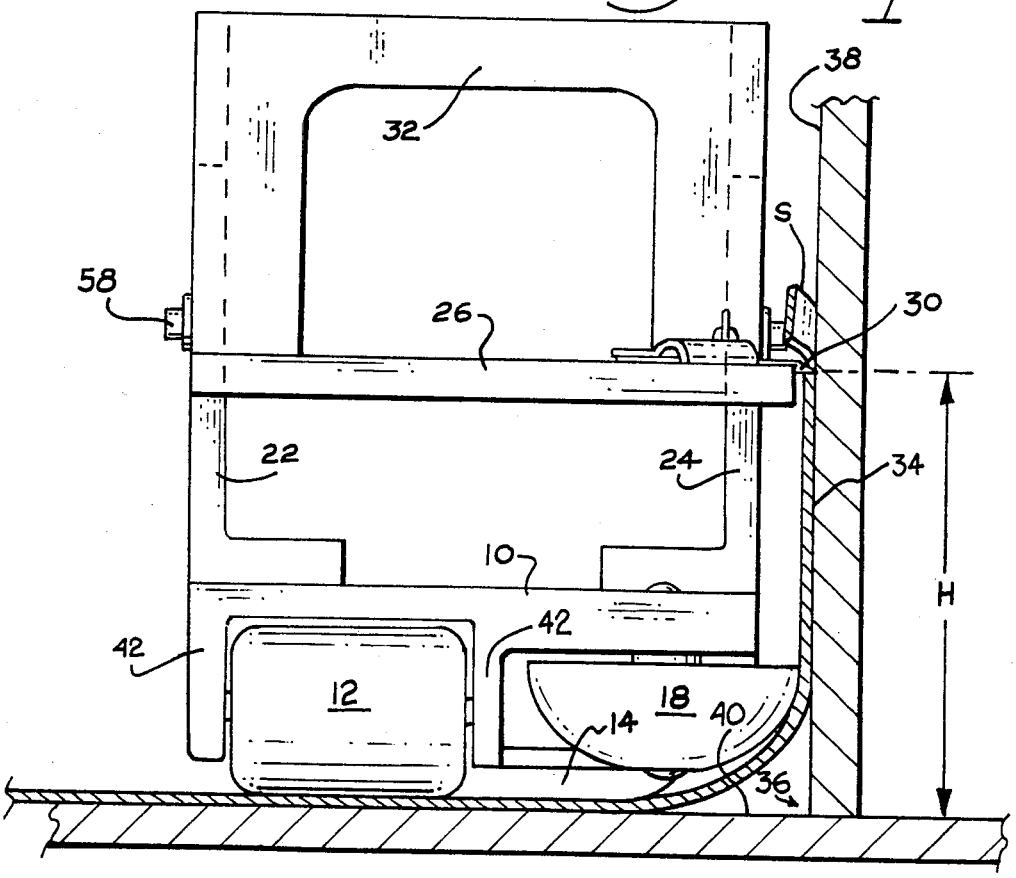

COVING CUTTER ASSEMBLY

BACKGROUND OF THE INVENTION

1. Field of the Invention

This invention relates generally to hand tools and more particularly to hand operated cutting tools.

2. Description of the Prior Art

A number of prior art devices cut flooring material so that it may lie flat against a wall surface. For example, in U.S. Pat. No. 3,844,038 of Kelly a sheet vinyl wall trimmer tool is described that includes a carriage supported by a number of free rolling ball wheels. A removable knife blade is attached to the carriage to cut the flooring material.

In U.S. Pat. No. 4,130,939 of Toal a device is taught which slides along the floor next to the wall rather than rolling as does the device taught in Kelly. Toal's device features a blade which can be attached to the device to cut in either direction along the wall. Further examples of trimming tools can be found in U.S. Pat. No. 3,653,124 of Evans, U.S. Pat. No. 3,395,453 of Prater, and U.S. Pat. No. 3,934,341 of Carlson.

The patents described above all cut flooring materials so that their edges lie flat against a wall surface. It is sometimes desirable, however, to have the flooring material lap against the lower portion of a wall surface to create a cove. The prior art does not disclose a device for forming a cove at the juncture of wall and floor surface, nor does it disclose a device which cuts flooring material such that it can cover a lower portion of the wall surface.

SUMMARY OF THE INVENTION

An object of this invention is to provide a coving cutter assembly which simultaneously forms and cuts flooring material to create a cove at a floor and wall surface juncture.

A further object of this invention is to provide a coving cutter assembly which is vertically adjustable to cut the flooring at different heights along the wall surface.

Yet another object of this invention is to provide a coving cutter assembly adapted for rugged, professional use.

Briefly, the invention includes a substantially rectangular base, three cylindrical wheels attached to an underside of the base, a pair of separated guide posts rising from an upper surface of the base, and a cutter plate attached to the guide posts. A pair of a razor blades are clamped to opposing ends of the cutter plate to cut the flooring material against the wall surface. The invention also includes cove forming means including a separated pair of half-spherical wheels coupled to the underside of the base and adapted to press the flooring material into the juncture between the wall and floor surface.

In use, the cutter plate is adjusted along the guide posts to the desired height and the cove forming wheels are pressed into the juncture between the wall and floor surfaces. The entire cutter assembly is then rolled along the floor parallel to the wall surface such that one of the razor blades cuts through the flooring material.

An advantage of this invention is that the coving cutter assembly simultaneously forms a cove and cuts the flooring material at a proper height.

A further advantage of this invention is that the cutter plate is vertically adjustable so that the coving height can be varied.

These and other objects and advantages of the present invention will no doubt become apparent upon a reading of the following descriptions and a study of the several figures of the drawing.

BRIEF DESCRIPTION OF THE DRAWING

FIG. 3 is a cross-sectional view taken along the line 3—3 of FIG. 2.

FIG. 4 is an end elevational view of the coving cutter taken along line 4—4 of FIG. 2.

DETAILED DESCRIPTION OF THE PREFERRED EMBODIMENT(S)

Figure 1:
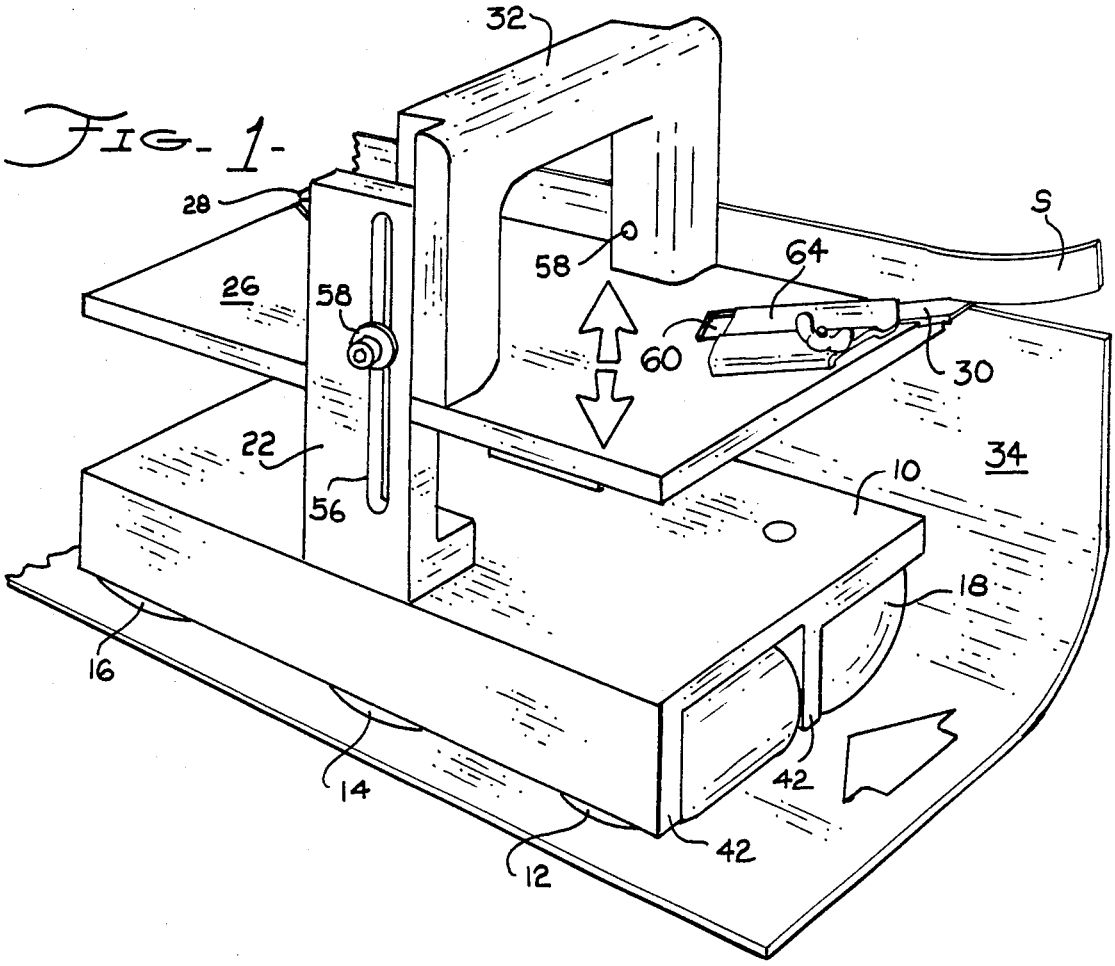
FIG. 1 is a perspective view of a coving cutter assembly in accordance with the present invention.
Figure 2:
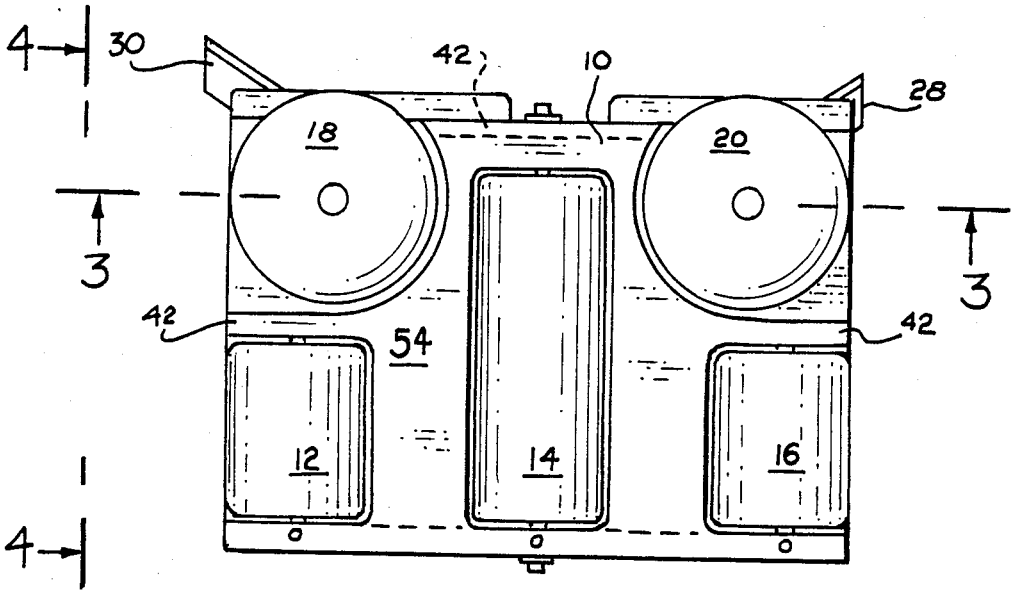
FIG. 2 is a bottom plan view of the coving cutter shown in FIG. 1.

Referring generally to the figures, a coving cutter assembly in accordance with the present invention includes a substantially rectangular base 10, three elongated, cylindrical roller wheels 12, 14, and 16, a pair of cove-forming wheels 18 and 20, a pair of guide posts 22 and 24, and a cutter plate 26 supported by guide posts 22 and 24. The assembly also includes a pair of cutting blades 28 and 30 and a handle 32 attached to cutter plate 26.

Referring briefly to FIG. 4, the present invention is used to form and cut a flexible flooring material 34 to make a cove at the juncture 36 of a wall surface 38 and a floor surface 40. Cove-forming wheels 18 and 20 press flooring material 34 into juncture 36 while blades 28 and 30 cut the flooring material 34 at a user selectable height "H" above floor surface 40.

Base 10 is substantially rectangular and is provided with a number of downwardly extending flanges 42. Wheels 12–16 are supported by axles 14–48 between a pair of flanges 42 for rotation around a horizontal axis. Cove forming wheels 18 and 20 are supported by axle pins 50 and 52, respectively, for rotation around a vertical axis. A base plate 54 is attached to the bottom surface of the flanges to protect the under surfaces of the base.

Guide posts 22 and 24 are "L" shaped members having a shorter leg portion attached to the upper surface of base 10 and a longer leg portion rising substantially vertically from the base. The guide posts are provided with elongated, vertical slots 56.

Cutter plate 26 is a rectangular, planar member, engaged with and supported by guide posts 22 and 24. Handle 32 is attached to the upper surface of cutter plate 26 and is provided with a pair of threaded bores receptive to a pair of adjustment bolts 58. The shanks of adjustment bolts 58 extend through vertical slots 56 of guide posts 22 and 24, and the heads of adjustment bolts 58 frictionally engage outer surfaces of the guide posts.

A pair of recesses 60 are provided in the upper surface of cutter plate 26 which are receptive to cutting blades 28 and 30. A pair of screw-operated clamps 62 and 64 are attached to cutter plate 26 to clamp cutting blades 28 and 30 within their respective recesses 60.

In use, the height of the cutter plate 26 is first adjusted by loosening adjustment bolts 58, sliding the cutter plate up or down along guide posts 22 and 24, and then re-tightening adjustment bolts 58. If the coving cutter apparatus is to cut to the left as indicated in FIG.

1, blade 30 is extended and then clamped by adjustment clamp 64. If the present apparatus is to be used to cut in the opposite direction, cutting blade 30 is retracted and cutting blade 28 is extended and clamped in place. Flooring 34 is then placed against wall surface 38 as seen in FIGS. 1 and 4, and cove-forming wheels 18 and 20 are pressed tightly against flooring material 34 to force the material towards juncture 36 between the floor and wall. The cove-cutting apparatus is then rolled along the floor surface such that a scrap strip "S" is cut from flooring material 34. Thus, in one step the flooring material is pressed into a cove forming configuration and the end of flooring material 34 is trimmed against the wall surface.

It will noted that cove-forming wheels 18 and 20 do not contact the floor surface 40 through flooring material 34, although they do contact wall surface 38 through the flooring material. The side of the base closest to wall surface 38 is supported by the forward extension of elongated cylindrical wheel 14. The side of the base farthest from wall surface 38 is supported by wheels 12 and 16 and the other end of cylindrical wheel 14.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications a fall within the true spirit and scope of the present invention.

What is claimed is:

1. A coving cutter assembly for cutting a flexible covering material to form a cove over the juncture of a substantially horizontal floor surface and a substantially vertical wall surface, said coving cutter comprising:

(a) base means having an upper surface, and an underside adapted for contact with said floor surface, said base means being provided with a plurality of floor engaging support wheels including an elongated, cylindrical support wheel capable of rotating around a horizontal axis;

(b) guide post means rising substantially vertically from said upper surface of said base means, said guide post means including a separated pair of guide posts attached to said upper surface;

(c) a cutter plate adjustably coupled to said guide post means such that the vertical separation between said cutter plate and said upper surface of said base means can be varied and set, and adjustable slide couplings engaged with said pair of posts and supporting said cutter plate;

(d) blade means attached to said cutter plate and adapted to cut said covering material against said wall surface when moved in a horizontal direction along said wall surface; and (e) cove forming means coupled to said base means and adapted to press said covering material into said juncture, where said cove forming means includes a separated pair of half-spherical wheels, and wherein said plurality of support wheels includes an elongated, cylindrical support wheel extending between said half-spherical wheels, and a pair of shorter, cylindrical support wheels located on either side of said elongated support wheel.

2. A coving cutter assembly as recited in claim 1 further comprising adjustable clamping means for attaching said blade means to said cutter plate.

3. A coving cutter assembly as recited in claim 1 further comprising handle means attached to said cutter plate.

4. A coving cutter assembly as recited in claim 1 wherein said blade means includes a pair of blades adjustably clamped to said cutter plate such that they may be angularly extended from opposing ends of said cutter plate.

* * * * *